US005947883A

United States Patent [19]

Feldkämper et al.

[11] Patent Number: 5,947,883

[45] Date of Patent: Sep. 7, 1999

[54] DEVICE FOR TRANSFERRING SLIPS OF PAPER FROM A FIRST ROTATIONALLY-DRIVEN CYLINDER TO A SECOND ROTATIONALLY-DRIVEN CYLINDER

[75] Inventors: Richard Feldkämper; Rüdiger Duwendag, both of Lengerich; Hermann Sandmeier, Bielefeld, all of Germany

[73] Assignee: Windmoeller & Hoelscher, Lengerich/Westf., Germany

[21] Appl. No.: 08/738,765

[22] Filed: Oct. 28, 1996

[30] Foreign Application Priority Data

| | | | |
|---|---|---|---|
| Oct. 31, 1995 | [DE] | Germany | 195 40 616 |
| Dec. 14, 1995 | [DE] | Germany | 195 46 802 |
| May 29, 1996 | [DE] | Germany | 196 21 586 |

[51] Int. Cl.[6] ..... B31B 1/90; B31F 1/08; B65H 5/02

[52] U.S. Cl. ..... 493/218; 493/219; 493/429; 271/277; 271/314

[58] Field of Search ..... 493/218, 219, 493/424, 426, 427, 428, 429; 271/277, 275, 306, 314

[56] References Cited

U.S. PATENT DOCUMENTS

| | | | |
|---|---|---|---|
| 2,092,568 | 9/1937 | Belluche | 271/277 |
| 3,231,261 | 1/1966 | Huffman | 493/429 |
| 3,839,959 | 10/1974 | Abendroth | 271/277 |
| 5,065,993 | 11/1991 | Reponty | 493/424 |
| 5,522,586 | 6/1996 | Bennett et al. | 493/429 |
| 5,547,452 | 8/1996 | Kepert et al. | 493/427 |

FOREIGN PATENT DOCUMENTS

| | | | |
|---|---|---|---|
| 0560066B1 | 9/1993 | European Pat. Off. . | |
| 2101974 | 1/1983 | United Kingdom | 493/426 |

*Primary Examiner*—William E. Terrell
*Assistant Examiner*—Joe Dillon, Jr.
*Attorney, Agent, or Firm*—Evenson, McKeown, Edwards & Lenahan, P.L.L.C.

[57] ABSTRACT

A device for transferring slips of paper from a first rotationally-driven cylinder to a second rotationally-driven cylinder. Each cylinder has a pincers-like gripper including a controlled, pivotal jaw that has the form of a blade cooperating with a rigid jaw of the same cylinder. The pivotal jaw also operates as a controlled insertion blade that slides the slips of paper into the opened gripper of the other cylinder. The structural design of the device is simplified due to the fact that the pivotal blade-shaped jaw of each cylinder is provided with a second control that can be activated on command which deactivates the control of the pincers movement of the jaw and controls the jaw in such a way that it functions as the insertion blade.

18 Claims, 5 Drawing Sheets

DEVICE FOR TRANSFERRING SLIPS OF PAPER FROM A FIRST ROTATIONALLY-DRIVEN CYLINDER TO A SECOND ROTATIONALLY-DRIVEN CYLINDER

BACKGROUND OF THE INVENTION

1. Field of the Invention

This invention pertains to a device for transferring slips of paper from a first rotationally-driven cylinder to a second rotationally-driven cylinder. Each of the cylinders includes a gripper with a controlled, pivotal jaw formed as a strip. The pivotal jaw cooperates with a rigid jaw of the corresponding cylinder. Each cylinder also has a controlled blade that inserts the slips of paper into the opened gripper of the other cylinder. Preferably, the invention is used for transferring bottom caps from the transfer or detaching cylinder of a bag manufacturing machine to an application cylinder that applies the bottom caps to open bottoms of continuously conveyed bags.

2. Description of Related Art

The present invention relates to the application of bottom caps to bags being continuously conveyed via a conveyor line. If such a device is used in a bag manufacturing machine, the bottom cap cannot be transferred from the transfer cylinder to the application cylinder whenever a bag fails to appear. This prevents an unused bottom cap from being delivered to the bag conveyor by the application cylinder and creating an obstruction. A device of this type is disclosed in EP 0,560,066 B1. In that device, if a bag fails to appear, a pincers-like gripper on the transfer cylinder is activated. The gripper takes hold of the bottom cap and transfers the bottom cap to a subsequently arranged separating conveyor for discarding the unneeded bottom cap. In this known device, the transfer and application cylinder are each provided with controlled, pincers-like grippers. Each cylinder is also provided with controlled blades that respectively insert the edge of bottom caps into the opened gripper of the other cylinder.

In operation, if a bag fails to appear at the bottom cap application site, then the bottom cap intended for the missing bag is disposed of by changing the control of the gripper and the blade so that the blade of the application cylinder inserts the bottom cap into the opened gripper of the transfer cylinder. The transfer cylinder then takes hold of the bottom cap and transfers the bottom cap to the subsequently-arranged separating conveyor. This known device is expensive to construct and maintain because the transfer cylinder, as well as the application cylinder, must each be provided with a controlled pincers-like gripper as well as a separately controlled blade that inserts the edge of bottom caps into the opened pincers-like gripper of the other cylinder.

SUMMARY OF THE INVENTION

The present invention is based on the objective of simplifying the structural design of the device mentioned above.

According to the present invention, this objective is attained by providing the pivotal, strip-shaped jaw of each cylinder with a second control mechanism that can be activated on command. The second control mechanism deactivates the pincers-like movement control of the strip-shaped jaw when the jaw is used as a gripper, and controls the jaw so that it functions as a blade.

The controlled pivotal jaw of each cylinder preferably has the shape of a strip that cooperates with a rigid jaw of the corresponding cylinder. The pivotal jaw is, or at least can be, used as a blade. This pivotal, strip-shaped jaw, when used as a blade, inserts the slip of paper or the bottom cap into the opened gripper of the other cylinder. There, the gripper of this other cylinder must take hold of the slip of paper or the bottom cap. These interchangeable functions are possible because only one gripper of one cylinder must perform the gripping function, i.e., the strip-shaped pivotal jaw of the deactivated gripper of the other cylinder takes over the function of the controlled blade that inserts the slips of paper.

In order to change the function of a pivotal strip-shaped jaw to that of a blade, the pivotal, strip-shaped jaw is provided with a second control capable of extending the strip-shaped jaw sufficiently far out of the cylinder sleeve to insert the slip of paper into the opened gripper of the other cylinder. At the same time, the jaw now functioning as a blade is moved into the vicinity of the stationary jaw of the other cylinder. The second control mechanism precludes a collision with the pivoted jaw of the other cylinder.

It goes without saying that cooperation between the pincers-like grippers of both cylinders in accordance with the invention requires that the diameters of both cylinders be adapted to one another in such a way that the activated gripper of one given cylinder can cooperate with the activated blade of the other cylinder. Consequently, the grippers of both cylinders must pass into the gap between the cylinders in correspondingly synchronous fashion.

The required controls and changes in the control of the strip-shaped jaw acting as the pincers-like grippers and controlled blades can be realized in different ways. According to one preferred embodiment, the control for the pivotal, strip-shaped jaws includes a shaft arranged in each cylinder parallel to the cylinder axis of rotation. The shaft carries two levers. A blade shaft carries the strip-shaped jaw. The blade could be arranged parallel to the shaft in freely rotatable fashion. The blade shaft carries two blade shaft levers that are provided with sliding pads or rollers. At least one of the blade shaft levers is held in contact with a limit stop that is rigidly mounted to the cylinder by a spring.

One roller of one of the two blade shaft levers rolls along a radial primary cam that is rigidly mounted to the frame of the device and controls the closing and opening movement of the pivotal jaw in the gripping mode. Two radial secondary cams are also provided. The secondary cams can be adjusted within the frame and moved between an active position, corresponding to the blade mode, and an inactive position corresponding to the gripping mode by a controlled drive. One roller is arranged on the blade shaft rolls along one of the secondary radial cams in the active position. The roller lifts the roller that controls the opening and closing movement of the pivotal jaw off the corresponding radial cam and controls the insertion and retraction movement of the jaw in the blade mode. A second roller of the other blade shaft lever rolls along the second radial cam and pivots the pivotal jaw toward the rigid jaw of the other cylinder to such an extent that it does not make impact with the pivotal jaw of the other cylinder. Due to this design, it is ensured that, in case of a change in control, the pivotal jaw takes over the function of a blade that inserts the slips of paper into the opened gripper of the other cylinder. In other words, the pivotal jaw carries out the insertion and retraction movement of the blade while suspending the gripping movement. At the same time, the pivotal jaw, now operating as a blade is moved into the vicinity of the rigid jaw of the other cylinder.

It is practical for a spring that holds the rolls of the blade shaft levers in contact with the corresponding radial cams to act upon at least one blade shaft lever, i.e., the radial cam that controls the pivoting movement in the gripper mode and the pivoting motion for moving the pivoted, strip-shaped jaw into the vicinity of the rigid jaw of the other cylinder in the blade mode.

It is practical to arrange both adjustable radial cams on a pivoted lever that is arranged on the frame and can be pivoted between its active position and its inactive position by a pneumatic piston/cylinder unit. Once the pneumatic piston/cylinder unit is activated by the machine control, the desired changes in control for the corresponding function of the pivotal, strip-shaped jaw can be realized.

Due to the elasticity of the slips of paper that must be transferred to and transported by the cylinders, the slips of paper may spring up such that the front edge region moves out of the open jaws of the gripper while the blade that slides the front edge of a slip of paper into the opened gripper is retracted. This may occur during the interval of time when the blade is retracted and the pivotal jaw has not yet firmly pressed the front edge region of the slip of paper against the rigid jaw.

In order to ensure that the grippers are able to securely take hold of the front edge region of slips of paper, it is proposed, in one preferred embodiment of the invention, to provide the pivotal jaw of each cylinder with at least one plunger of elastomeric material. This plunger presses the front region of the slip of paper against the surface section of the other cylinder which is formed by the end surface of the rigid jaw or the surface section that is situated adjacent to the rigid jaw. Due to this design, it is ensured that the front region of each slip of paper to be transferred is held in contact with the outer surface of the cylinder that receives the slip of paper during the critical phase in which the blade is retracted and the grippers are closed. As a result, the inserted front edge region of the slip of paper cannot move out of the jaws of the opened gripper.

The plungers preferably include rod-shaped sections that are arranged in bores in the blade shaft of each cylinder or held thereon and extend through the approximately radial bores of the surface sections. The bores of the surface sections end within the region of the rigid jaw of the other cylinder. The bores of one surface section which are arranged in the form of a row are offset relative to the bores of the other surface section such that the plungers do not impact with one another. The plungers instead cooperate with the opposite surface section.

It is practical to have the diameters of the bores of the surface sections larger than the diameters of the rod-shaped sections. The rod-shaped plungers preferably have sufficient lengths so as to elastically engage on the surface section of the other cylinder over a sufficiently long path. However, if the rod-shaped sections buckle while the slip of paper is pressed against the other cylinder, their diameters increase due to compression. The diameter of the bores of the surface sections are adapted to receive this increase in diameter.

It is also practical to clamp the rod-shaped sections of the plungers in the bores of the blade shafts using the fixing screws which hold the strip-shaped jaw to the blade shaft.

In order to prevent the plungers of both cylinders from hindering one another while the slip of paper is pressed against a cylinder, the rod-shaped sections can be eccentrically fastened to the blade shafts in such a way that they are radially retracted into the bores of the surface section while the gripper is closed.

BRIEF DESCRIPTION OF THE DRAWINGS

One embodiment of the invention is described in detail below with reference to the drawing figures.

DESCRIPTION OF THE PREFERRED EMBODIMENTS

Figure 1:
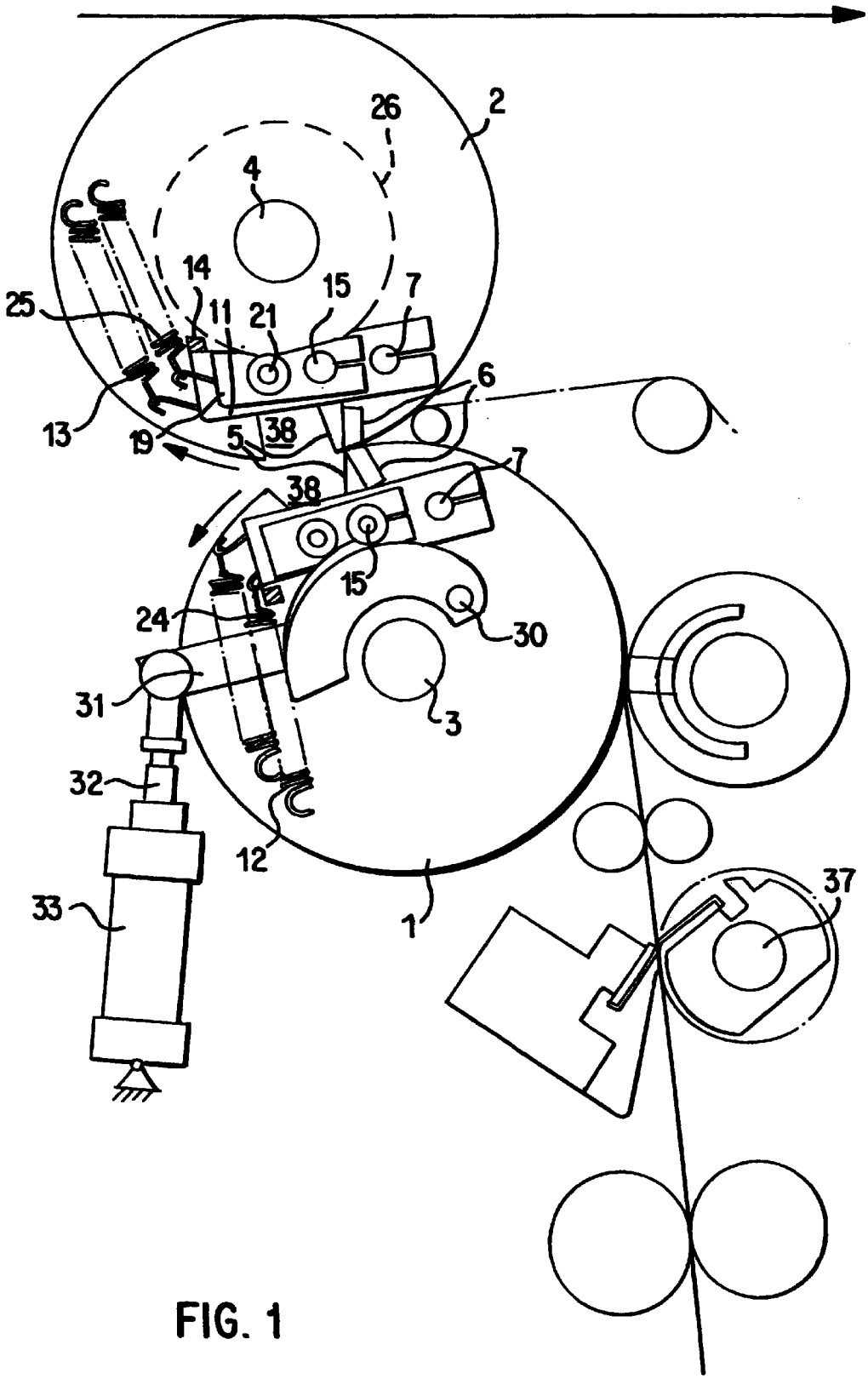
FIG. 1 is a schematic side view of a device for detaching slips of paper from a web and transferring the slips of paper to continuously-conveyed bags.

FIG. 1 illustrates a preferred embodiment of the present invention for tearing off or detaching bottom caps from a web and transferring the bottom caps to the open bottoms of continuously-conveyed bags. A device similar to the present device is described in Applicants' prior German Patent No. 195 40 148.-26, dated Oct. 27, 1995, to which reference is made for a more detailed illustration.

If bags fail to appear during manufacturing, the bottom caps received by the transfer or detaching cylinder 1 cannot be transferred to the application cylinder 2 that serves for applying the bottom caps to the bags. The transfer or detaching cylinder must instead transfer these bottom caps to a separating conveyor (not shown) that discards these bottom caps. This conveyor is described in EP 0,560,066 B1, to which reference is made in this respect.

The shafts 3, 4 of the transfer cylinder 1 and the application cylinder 2 respectively are arranged in the machine frame (not shown) and provided with conventional drives which rotate the cylinders as indicated by the arrows.

Each of the cylinders 1, 2 has a pincers-like gripper in an axially parallel gap 38 of the cylinder. These grippers respectively consist of a pivotal blade-shaped jaw 5 and a stationary jaw 6. Since the transfer cylinder and the application cylinder 1, 2 are constructed essentially in the same way, identical components are identified by the same reference numerals.

The transfer cylinder 1 and the application cylinder 2 are arranged in the form of a mirror image, such that the grippers simultaneously pass into the gap 38 between the cylinders. Due to this mirror-image arrangement, FIG. 1 shows the opposing sides of the respective cylinders.

The arrangement for controlling the pivotal, blade-shaped jaw 5 as a gripping jaw is described below with reference to cylinder 2 in FIG. 1 and the right side of the cylinder of FIG. 2.

Figure 2:
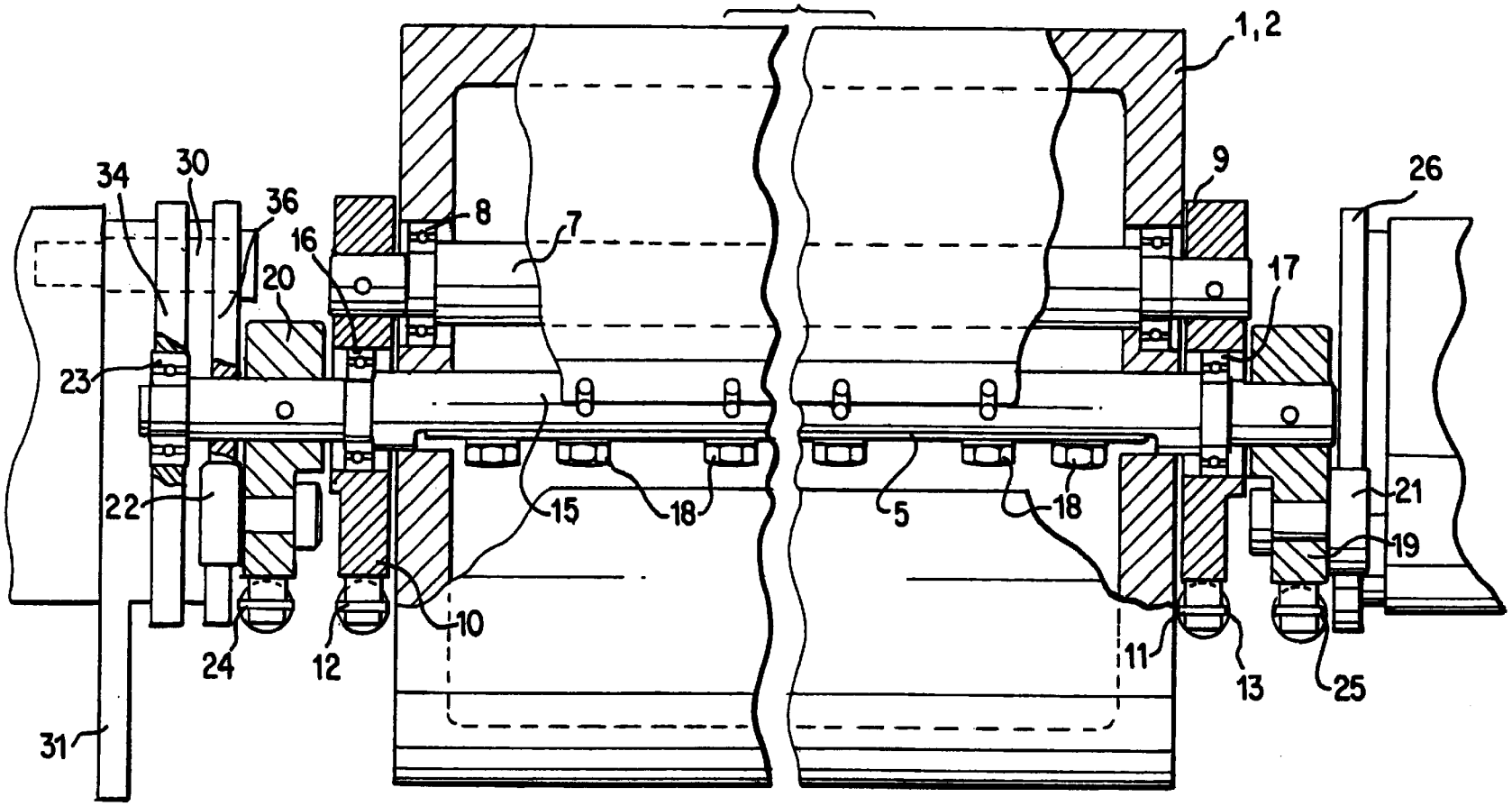
FIG. 2 is a schematic, partially sectioned front view of a transfer or application cylinder, both of which are essentially realized identically.

As shown in FIG. 2, shaft 7 is arranged eccentrically to the cylinder axis near the outer walls of each cylinder 1, 2. The ends of shaft 7 cooperate with rolling bearings 8, 9 such that shaft 7 can freely rotate. Levers 10, 11 are arranged on the ends of the shaft 7. Levers 10, 11 are pretensioned in the direction toward a limit stop 14 that is rigidly mounted to the cylinder by tensioning springs 12, 13. A blade shaft 15 is arranged on rolling bearings 16, 17 such that blade shaft 15 can be rotated by levers 10, 11 at a distance offset from the axis of the shaft 7. The blade shaft 15 extends parallel to the shaft 7 axis. The blade-shaped jaw 5 is fastened to the blade shaft 15 by fixing screws 18. Blade levers 19, 20 that carry freely-rotatable rollers 21, 22 are mounted to the end regions of the blade shaft 15. One additional roller 23 is arranged on an end of the blade shaft.

The blade shaft levers 19, 20 are pretensioned in the direction toward the corresponding radial cams 26 and 36 by tensioning springs 24, 25 mounted to the ends of the blade shaft levers.

Roller 21 of the blade shaft lever 19 rolls along the radial cam 26 that is rigidly mounted to the frame and illustrated by broken lines in FIG. 1. In the gripping mode, the radial cam 26 controls the opening and closing movement of the blade-shaped jaw 5 by correspondingly rotating the blade shaft 15. In this gripping mode, the levers 10 and 11 are held in contact with the limit stops 14 that are rigidly mounted to the cylinder by their respective tensioning springs 12, 13.

Pivoted radial cams 34 and 36 are provided on the other end of blade shaft 15. Radial cams 34 and 36 control the blade-shaped jaw 5 in the blade mode. An actuator lever 31 is arranged such that it can be pivoted around a pin 30 that is rigidly mounted to the frame. The free end of actuator lever 31 is connected to the piston rod 32 of a pneumatic cylinder 33 in articulated fashion. Although not shown in the figure, this pneumatic cylinder can be pivoted within the frame. Radial cam 34 controls the extension and retraction movement of the blade-shaped jaw 5 in the blade mode. Radial cam 34 is arranged on the lever 31. Roller 23, which is mounted to the end of the blade shaft 15, rolls along the curve segment of radial cam 34 once during each revolution of the cylinder.

The lever 31 carries an additional radial cam 36 that is arranged parallel to radial cam 34. Radial cam 36 controls the pivoting movement of the blade-shaped jaw 5 in the blade mode in such a way that the blade-shaped jaw 5 cannot collide with the blade-shaped jaw in the other cylinder. Roller 22 of the blade shaft lever 20 rolls along the radial cam segment 36.

Figure 4A:
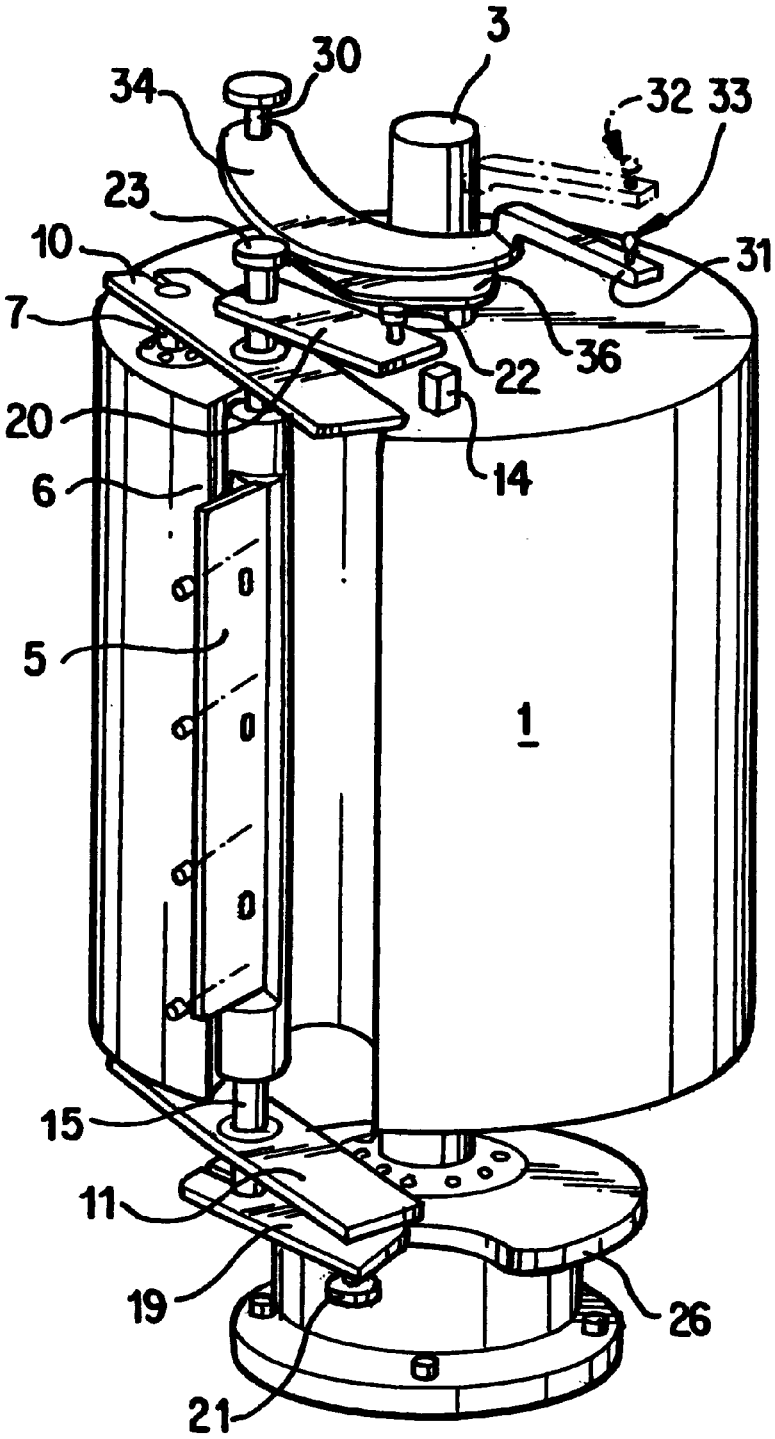
FIGS. 4A and 4B are perspective views of the cylinder in the blade mode and gripping mode, respectively.
Figure 4B:
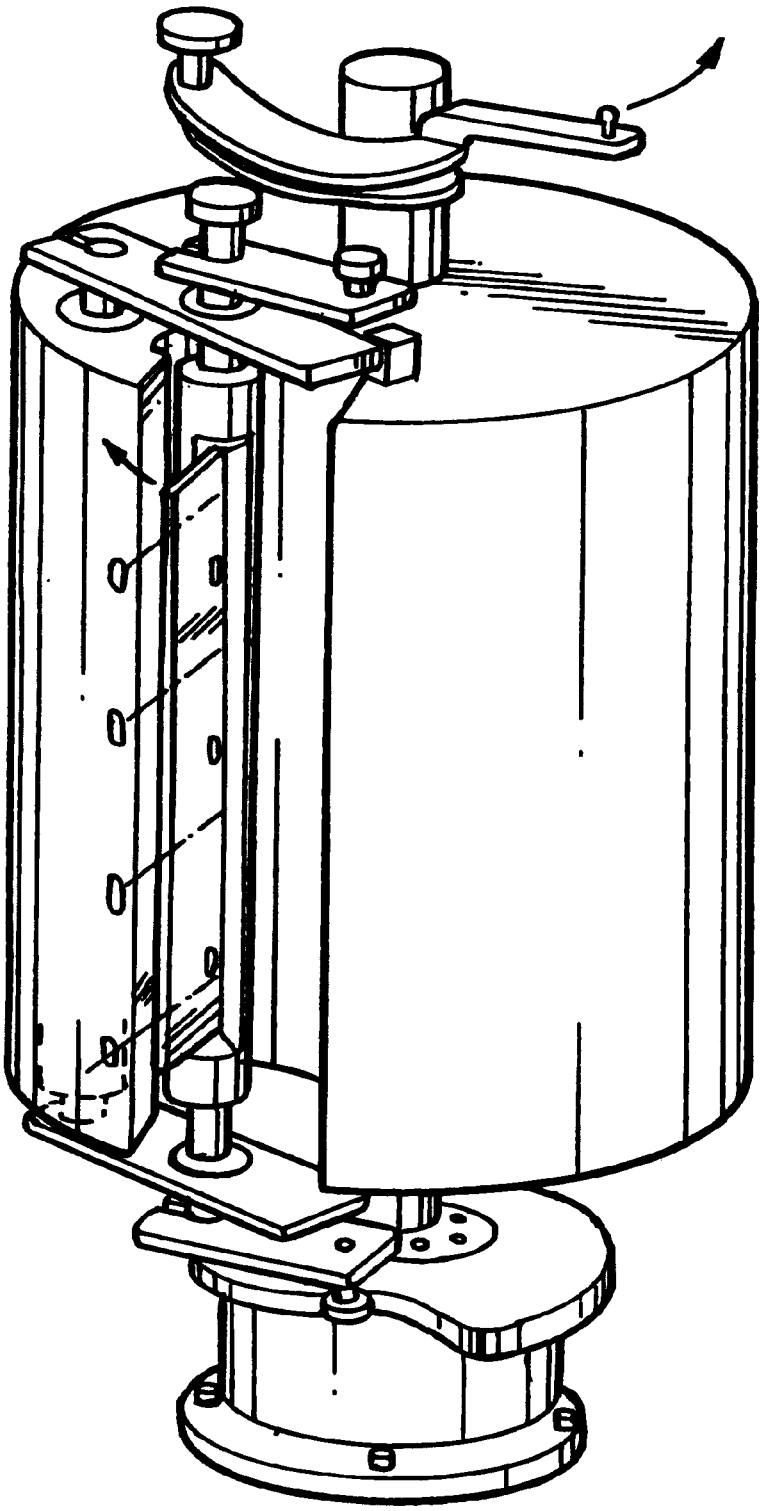

In the gripping mode as shown in FIG. 4B, the pneumatic cylinder 33 pivots the lever 31 with the radial cam segments 34, 36 in the direction toward the cylinder axis. As such, the radial cams 34, 36 are unable to move the rollers 22, 23. In this mode, the blade-shaped jaw 5 does not move in an insertion or retraction direction due to the lack of movement from rollers 22, 23. In this inactive position of the radial cams 34, 36, roller 21 of the blade shaft lever 19 rolls along the radial cam 26 such that the blade shaft lever is turned toward stationary jaw 6. The turning movement corresponds to the closing and opening movement or gripping action of the blade-shaped jaw 5 and stationary jaw 6. In this mode, the bottom caps are transferred from transfer cylinder 1 to application cylinder 2.

In the blade mode, shown in FIG. 4A, the pneumatic cylinder 13 is extended such that it pivots the curve segments of radial cams 34, 36 into their active positions. Lever 11 is lifted off the limit stop 14 and deactivates roller 21 from radial cam 26. Subsequently, the blade shaft levers 19, 20 are pivoted by the radial cam segment 34 via the roller 23 such that the blade-shaped jaw 5 carries out the extension and retraction movement which pushes the edge portion of a sheet into gap 35. This movement is superimposed with a pivoting movement via the curve segment 36 and the roller 22 in order to move the blade-shaped jaw 5 in the vicinity of the stationary jaw 6 of the opposite cylinder.

According to an additional embodiment of the invention, it is contemplated that the cylinders with the controlled, pivotal blade-shaped jaws can also be operated in such a way that the blade-shaped jaws are deactivated without being controlled. This means that the cylinders fulfill neither a blade function nor a gripping function, but rather only a guide or transport function. In order to prevent the devices that control the blade-shaped jaws from wearing out in this particular operational mode of the cylinders, the corresponding control devices are entirely deactivated. For example, this can be realized by both deactivating the radial cams 34, 36 that cause the pivoting movement of the blade-shaped jaw in the blade mode and deactivating the radial cam 26 that subjects the blade shaft lever 19 to the rotational movement that causes the opening and closing movement of the blade-shaped jaw in the gripping mode. The deactivation of the radial cam 26 can be realized, for example, by axially displacing the radial cam so that it is disengaged from the roller 21 of the blade shaft lever 19.

Figure 3:
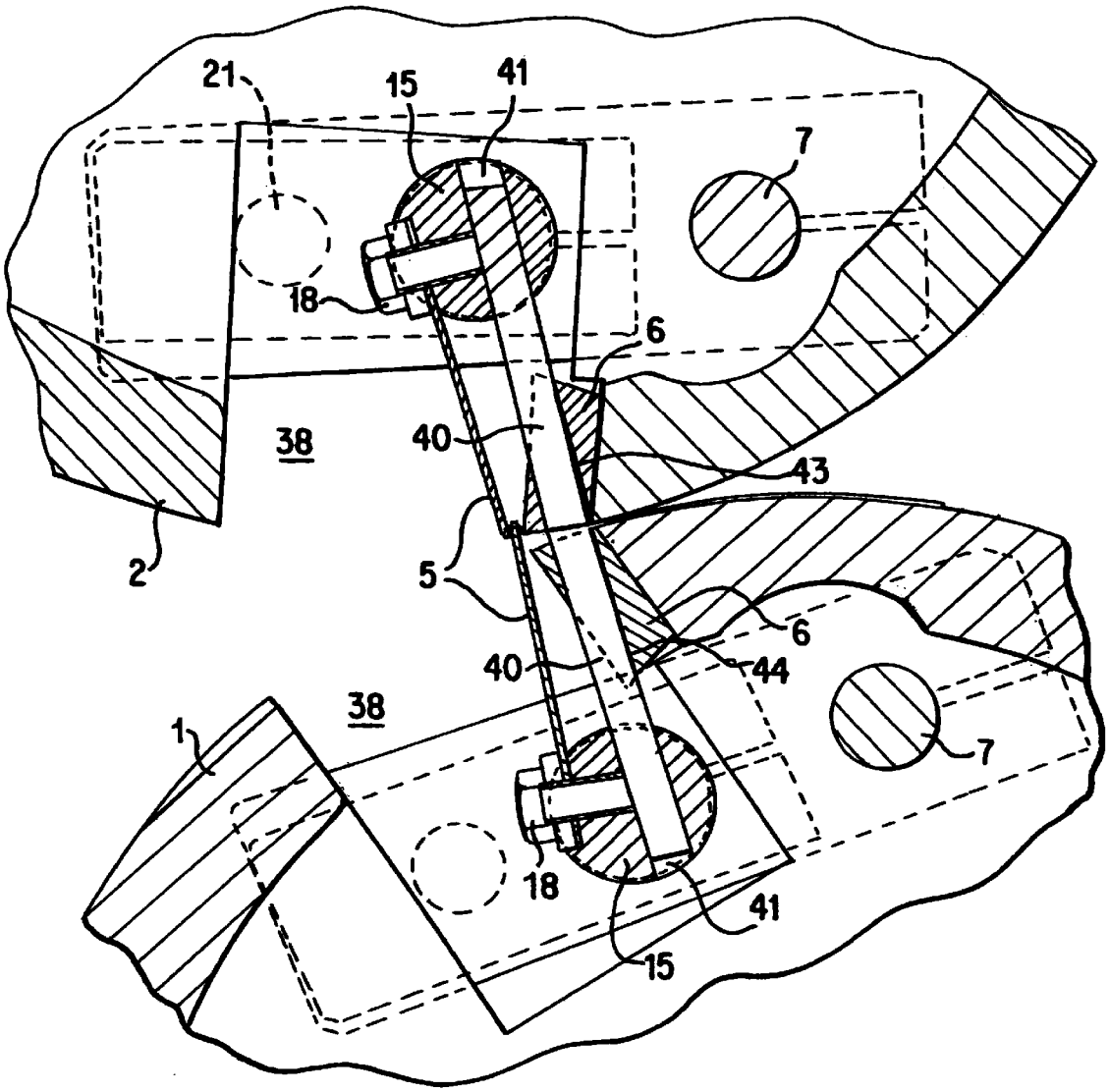
FIG. 3 is an enlarged detail of FIG. 1 that shows the rod-shaped plungers that are fastened to the blade shafts and extend through approximately radial bores of the surface sections formed by the rigid jaws.

FIG. 3 shows the arrangement and mounting of the rod-shaped plungers 40 that can be moved with the blade-shaped jaws 5. The blade shaft 15 is provided with lateral bores 41 arranged suitable distances from one another. One end of the rod-shaped plungers 40 is inserted into these lateral bores. The plungers 40 are clamped in the bores by the fixing screws 18.

The end surfaces of the stationary jaws 6 that are connected to the cylinder sleeve form surface sections that are arranged adjacent to the radial clamping surfaces. The stationary jaws 6 are provided with bores 43, 44 that extend approximately radially to the cylinders 1, 2 as shown in FIG. 3. The aforementioned bores end at the surface sections of the cylinders which are formed by the stationary jaws. The rod-shaped plungers 40 extend through and are guided in the bores 43, 44.

The bores 43, 44 that are arranged in rows are respectively offset relative to one another. Due to the substantial length of the rod-shaped plungers 40 of elastomeric material, these plungers are able to perform a long spring travel while they press the front region of the slips of paper against the other cylinder. The front edges of the slips of paper which have been inserted into the open gripper remain in the inserted position after the jaw 5, acting in the blade mode has been extended until the other jaw closes.

The bores 43 have a larger diameter than the rod-shaped plungers such that the plungers are able to widen in the desired fashion during their buckling.

What is claimed is:

1. A device for transferring slips of paper comprising:

a first rotationally-driven cylinder and a second rotationally-driven cylinder to which the slips of paper are transferred from the first rotationally-driven cylinder, a controlled, pivotal blade-shaped jaw and first control included on each of the cylinders, said pivotal blade-shaped jaw being selectively operable as either a gripper blade or an insertion blade, a stationary jaw included on each of the cylinders, the pivotal jaw of one cylinder being controlled by the first control to cooperate with the stationary jaw of that cylinder to define a pincers-like gripper, wherein each pivotal blade-shaped jaw of each cylinder is provided with a second control that can be activated on command to deactivate the first control of the blade-shaped jaw and control said jaw in such a way that it functions as the insertion blade to slide an edge of the slip of paper into the pincers-like gripper of the other cylinder, and in that diameters of both of the cylinders are adapted to one another in such a way that the activated gripper of one cylinder can cooperate with the activated blade of the other cylinder.

2. A device according to claim 1, wherein the first control that controls the pincers movement of the pivotal blade-shaped jaw can also be deactivated while the second control of this blade-shaped jaw is deactivated.

3. A device according to claim 2, wherein the first radial cam that controls the pincers movement of the blade-shaped jaw can be axially displaced in order to deactivate the control of the pincers movement, such that said radial cam is disengaged from the lever that causes this pincers movement.

4. A device according to claim 1, wherein a shaft is arranged in each cylinder parallel to the cylinder's axis of rotation, said shaft carrying two levers, further wherein a blade shaft is arranged in each cylinder, said blade shaft carrying the blade-shaped jaw, said blade shaft being arranged parallel to the shaft in freely rotatable fashion, said blade shaft further comprises two blade shaft levers that are provided with sliding rollers wherein at least one lever is held in contact with a limit stop that is rigidly mounted to the cylinder by a spring, further wherein one roller of one of the two blade shaft levers rolls along a first radial cam that is rigidly mounted to a frame of the cylinder and controls the closing and opening movement of the pivotal blade-shaped jaw when operated as a gripper blade, further wherein a second and third radial cam are provided that can be adjusted on the frame and moved by a controlled drive between an active position that controls the pivotal blade-shaped jaw when operating as the insertion blade and an inactive position, wherein one roller that is arranged on the blade shaft rolls along the second radial cam in the active position lifting the roller that controls the opening and closing movement of the pivotal blade-shaped jaw off the first radial cam, and controls extension and retraction movement of the pivotal blade-shaped jaw when operated as an insertion blade, and wherein said roller on the other blade shaft lever rolls along the third radial cam and pivots the pivotal blade-shaped jaw in the direction toward the stationary jaw of the other cylinder to such an extent that it does not make impact with the pivotal blade-shaped jaw operating as a gripping blade on the other cylinder.

5. A device according to claim 4, wherein the second and third radial cams are arranged on a lever that is mounted to the frame in pivoted fashion, such that it can be pivoted between its active position and its inactive position by means of a pneumatic piston/cylinder unit.

6. A device according to claim 5, wherein the first control that controls the pincers movement of the pivotal blade-shaped jaw can also be deactivated while the second control of this blade-shaped jaw is deactivated.

7. A device according to claim 4, wherein a spring acts upon at least one blade shaft lever holding the rollers of the blade shaft levers in contact with the corresponding radial cams.

8. A device according to claim 7, wherein both the first and second adjustable radial cams are arranged on a lever that is mounted to the frame in pivoted fashion, such that it can be pivoted between an active position and an inactive position by means of a pneumatic piston/cylinder unit.

9. A device according to claim 7, characterized by the fact that the device that controls the pincers movement of the pivoted, strip-shaped jaw can also be deactivated while the control of the blade function of this strip-shaped jaw is deactivated.

10. A device according to claim 1, wherein the pivotal blade-shaped jaw of each cylinder is provided with at least one plunger of elastomer material which presses a front region of the slip of paper to be transferred against a surface section formed by an end surface of the rigid jaw or a surface section of the other cylinder which is situated adjacent to the rigid jaw.

11. A device according to claim 10, wherein the plungers comprise rod-shaped sections that are arranged in bores of the blade shaft or are held thereon and extend through bores in a surface section which extend approximately in the radial direction, and that the bores of the surface section end in the region of the stationary jaws of the other cylinder.

12. A device according to claim 11, wherein the rod-shaped plungers are eccentrically fixed on the blade shaft in such a way that they are radially retracted into the bores in the surface section while the pincers-like grippers are closed.

13. A device according to claim 11, wherein the rod-shaped plungers are clamped in the bores of the blade shaft by fixing screws.

14. A device according to claim 13, wherein the rod-shaped plungers are eccentrically fixed on the blade shaft in such a way that they are radially retracted into the bores in the surface section while the pincers-like grippers are closed.

15. A device according to claim 11, wherein the bores in the surface section have a larger diameter than the rod-shaped plungers.

16. A device according to claim 15, wherein the rod-shaped plungers are clamped in the bores of the blade shaft by fixing screws.

17. A device according to claim 15, wherein the rod-shaped plungers are eccentrically fixed on the blade shaft in such a way that they are radially retracted into the bores in the surface section while the pincers-like grippers are closed.

18. An apparatus for transferring slips of paper comprising:

a rotationally driven first cylinder for supplying slips of paper, said first cylinder further comprising;

a first stationary blade formed on a wall of a longitudinal recess in an outer surface of said cylinder, a first blade-shaped pivotal jaw disposed in said recess, a first gripping control mechanism positioned at one end of said first pivotal jaw, said first control mechanism being adapted to intermittently pivot said first pivotal jaw toward said first stationary jaw thereby defining a gripping movement, and a first insertion control mechanism positioned at an opposite end of said first pivotal jaw, said first insertion control mechanism being adapted to deactivate said first gripping control mechanism and to intermittently pivotally extend said first pivotal jaw out of said recess and retract said first pivotal jaw back into said recess thereby defining a blade insertion movement;

a rotationally driven second cylinder for receiving slips of paper supplied from said first cylinder, said second cylinder further comprising;

a second stationary blade formed on a wall of a longitudinal recess in an outer surface of said second cylinder, a second blade-shaped pivotal jaw disposed in said recess, a second gripping control mechanism positioned at one end of said second pivotal jaw, said second control mechanism being adapted to intermittently pivot said second pivotal jaw toward said second stationary jaw thereby defining a gripping movement, and a second insertion control mechanism positioned at an opposite end of said second pivotal jaw, said second insertion control mechanism being adapted to deactivate said second gripping control mechanism and to intermittently pivotally extend said second pivotal jaw out of said recess and retract said second pivotal jaw back into said recess thereby defining a blade insertion movement;

wherein said first and second cylinders are positioned relative to one another such that during rotation of said cylinders said first and second pivotal jaws can be selectively controlled whereby one of said first or second pivotal jaws operates in said blade movement to insert an edge of the slip of paper into said recess of the other cylinder where said pivotal jaw of that cylinder operates in said gripping movement to grip the edge of the slip of paper.

* * * * *